US007407429B2

(12) United States Patent
Chen

(10) Patent No.: US 7,407,429 B2
(45) **Date of Patent: *Aug. 5, 2008**

(54) GARMENT WITH INTEGRAL BRA SYSTEM

(76) Inventor: David E. Chen, 20912 Granite Wells Rd., Walnut, CA (US) 91789

( * ) Notice: Subject to any disclaimer, the term of this patent is extended or adjusted under 35 U.S.C. 154(b) by 759 days.

This patent is subject to a terminal disclaimer.

(21) Appl. No.: 10/866,847

(22) Filed: Jun. 14, 2004

(65) Prior Publication Data

US 2005/0277363 A1 Dec. 15, 2005

(51) Int. Cl.
*A41C 3/00* (2006.01)
*A41C 3/10* (2006.01)

(52) U.S. Cl. ..... 450/54; 450/58; 450/81

(58) Field of Classification Search ..... 450/36–39, 450/54–58; 623/7, 8
See application file for complete search history.

(56) References Cited

U.S. PATENT DOCUMENTS

| | | | |
|---|---|---|---|
| 817,020 | A | 4/1906 | Thompson |
| 2,079,426 | A | 5/1937 | Schottenfels |
| 2,579,365 | A | 12/1951 | Conde |
| 2,728,079 | A | 12/1955 | Williams |
| 2,793,369 | A | 5/1957 | Panighini |
| 2,844,151 | A | 7/1958 | Lemons |
| 2,869,553 | A | 1/1959 | D'Or |
| 2,882,905 | A | 4/1959 | Barg |
| 3,196,878 | A | 7/1965 | Hedu |
| 3,280,818 | A | 10/1966 | Pankey et al. |
| 3,297,036 | A | 1/1967 | Williams |
| 3,556,107 | A | 1/1971 | Brumfield |
| 3,749,102 | A | 7/1973 | Wynants |
| 3,934,593 | A | 1/1976 | Mellinger |
| 4,553,550 | A | 11/1985 | Hattori |
| 4,992,074 | A | 2/1991 | Diaz |
| 5,352,307 | A | 10/1994 | Wild |

(Continued)

FOREIGN PATENT DOCUMENTS

| | | |
|---|---|---|
| DE | 0216441 | 7/1961 |

(Continued)

OTHER PUBLICATIONS

Abstract and Figures Only for French Patent No. 2505620 (Nov. 19, 1982).

(Continued)

*Primary Examiner*—Gloria Hale
(74) *Attorney, Agent, or Firm*—Christie, Parker & Hale, LLP.

(57) ABSTRACT

A garment having an integral backless, strapless bra, and a method of using the garment. The garment includes a chest portion facing towards a user's breasts and a pair of bra cups adjoined to an inside surface of the chest portion. Each bra cup includes an interior surface facing towards a user's breast and an exterior surface facing opposite the interior surface, wherein the interior surface includes a pressure sensitive adhesive layer for adjoining the bra cups to the user's breast. The garment also includes a connector adapted to draw the bra cups together, wherein the connector is positioned between the bra cups. A method of using the garment provides for customizable positioning of the bra cups and optional degrees of breast cleavage and push-up enhancement.

17 Claims, 3 Drawing Sheets

U.S. PATENT DOCUMENTS

| | | | | |
|---|---|---|---|---|
| 5,538,502 | A | 7/1996 | Johnstone | |
| 5,755,611 | A | 5/1998 | Noble et al. | |
| 5,792,292 | A | 8/1998 | Wild | |
| D419,279 | S | 1/2000 | Marco et al. | |
| 6,200,195 | B1 | 3/2001 | Furuno et al. | |
| 6,231,424 | B1 | 5/2001 | Valentin | |
| 6,257,951 | B1 | 7/2001 | DeMarco | |
| 6,257,952 | B1 | 7/2001 | Valentin | |
| 6,283,820 | B1 | 9/2001 | Huang | |
| 6,615,832 | B1 * | 9/2003 | Chen | 128/206.26 |
| 6,758,720 | B2 * | 7/2004 | Chen | 450/57 |
| 6,780,081 | B2 * | 8/2004 | Chen et al. | 450/81 |
| 6,852,001 | B2 * | 2/2005 | Chen et al. | 450/57 |
| 6,857,932 | B2 * | 2/2005 | Chen | 450/38 |
| 6,916,224 | B2 * | 7/2005 | Chen et al. | 450/57 |
| 7,052,359 | B2 * | 5/2006 | Chen et al. | 450/54 |
| 2001/0021620 | A1 | 9/2001 | DeMarco | |
| 2001/0027079 | A1 | 10/2001 | Valentin | |

FOREIGN PATENT DOCUMENTS

| | | | |
|---|---|---|---|
| FR | 989453 | A | 9/1951 |
| FR | 1092914 | | 4/1955 |
| GB | 0785851 | | 11/1957 |
| GB | 2208785 | A | 4/1989 |
| KR | 10-0419298 | | 2/2004 |

OTHER PUBLICATIONS

Figures Only for Italian Patent No. IT 0521811 (May 1955).

Dr. Leonard's—America's Leading Discount Healthcare Catalog, p. 15, Natural Looking Breast Enhancer Pads, Silicone Covered with Film, 1998.

* cited by examiner

GARMENT WITH INTEGRAL BRA SYSTEM

FIELD OF THE INVENTION

The present invention relates to a garment having an integral bra system, and more particularly, to a garment having an adjustable backless, strapless bra.

BACKGROUND OF THE INVENTION

Various devices and methods are available to women who wish to enhance their breasts. Generally, women can either undergo a surgical procedure to be fitted with a breast implant, or can use some form of externally worn article. To accommodate women wishing to avoid the dangers involved with surgical breast implants, several efforts have been made to provide externally worn articles that have the look and feel of natural breasts, yet are non-permanent and health-risk free. Such externally worn devices have included a wide range of foam pads, push-up bras, and more recently gelled breast inserts to be worn between the user's breasts and a bra.

In addition to the demand for devices and methods for enhancing breast size and shape, there is also a demand for being able to use those devices and methods while wearing a full-range of clothing. For example, women wearing a backless dress or a halter top will not want to wear a traditional bra. As a result, bras have been developed that are both backless and strapless. Such backless, strapless bras have used non-permanent adhesives, such as a disposable double-sided tape, to secure the bra to the user. There have also been garments, such as shirts, that include some type of breast support function, but do not provide the full utility of a standalone bra.

As a result, there exists a need for a garment that includes an integral backless, strapless bra having a system for pushing-up the breasts and enhancing breast cleavage. Further, there exists a need for such a garment where the bra includes a re-usable adhesive that allows the user to position the bra in a desired position without concern of the bra shifting from that position.

SUMMARY OF THE INVENTION

The present invention provides a garment having an integral backless, strapless bra system, where the bra system comprises a pair of bra cups having an interior surface facing towards a user's skin that comprises a pressure sensitive adhesive layer for adjoining the bra cups to the user's skin. The bra cups are positioned within the garment such that the exterior surface of the bra cups is attached to the garment and the interior surface of the bra cups are attachable to the user's breasts. The bra cups are permanently or removably adjoined together, which in combination with the pressure sensitive adhesive layer allows the bra cups to be used as a customizable, repositionable system for creating a desired breast appearance. This includes allowing a user of the garment and bra cups to create a desired amount of breast cleavage and breast push-up enhancement.

DETAILED DESCRIPTION

A garment with an integral bra system constructed according to principles of this invention, generally comprises a garment with a pair of bra cups adapted to be joined together. The garment can be any type of garment designed to be worn over the torso of a person and to cover the breasts of the person, including, but not limited to, t-shirts, tank tops, tube tops, swimsuits, dresses, long-sleeved shirts/dresses, short-sleeved shirts/dresses, button down or zippered shirts/dresses, pullover shirts/dresses, etc. The garment can also be made of any suitable type of material or fabric. In an exemplary embodiment, the garment is made from a two-way or four-way stretchable fabric such as LYCRA or SPANDEX in order to allow the garment to conform to the shape of the user's breasts after the bra cups have been positioned over the user's breasts, particularly in a lateral direction across the user's chest. Furthermore, using at least a two-way stretchable fabric or material that stretches in a lateral direction across the user's chest allows the position of the bra cups to be changed relative to the user's breasts without causing the garment to be bunched together or overly extended near the center of the user's chest.

The bra system is integral with, or built-into, the garment, meaning that the bra system is a part of the garment. The attachment between the garment and bra system, however, can be achieved numerous ways and at different stages in the manufacturing process. Thus, the garment and bra system may be presented to the end consumer as a single, integral garment, but can be assembled separately and then combined later. Generally, the garment will comprise a chest portion that faces towards the user's chest when worn. The chest portion comprises an inside surface that faces towards the user's skin and an outside surface facing opposite the inside surface. The bra cups are adjoined with the inside surface of the chest portion of the garment, such that the bra cups can be worn over the user's breasts underneath the garment.

Figure 1:
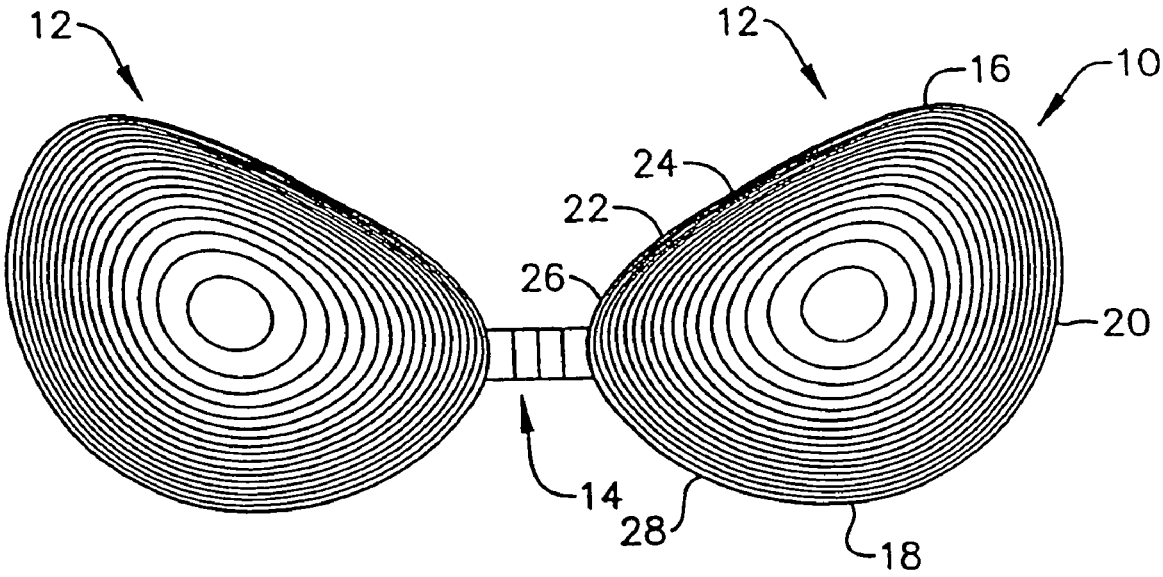
FIG. 1 is a front view of an exemplary backless, strapless bra having a pair of bra cups adjoined by a connector.

An exemplary bra system generally comprises a backless, strapless bra 10, as shown in FIG. 1. The bra 10 includes a pair of bra cups 12 adapted to be joined together by a center connector 14 that is positioned between opposing inner surfaces of the two bra cups. The connector is shown as having separate components that attach to each of the bra cups, but any configuration or structure having means to draw the two bra cups together can be a suitable connector, including the garment itself achieving that function. The bra cups 12 each have a pressure sensitive adhesive layer on their interior surfaces that enables the bra cups to be removably attached to each of a user's left and right breasts. The bra cups 12 are separate articles that are independently placed on a left and right breast of a user. Each of the bra cups 12 has the same structure, except one is designed to support and enhance the left breast and the other is designed to support and enhance the right breast. Furthermore, the bra cups can be either permanently or removably adjoined by the connector.

Generally, the user of the bra 10 puts on the garment having the bra 10 and positions the pressure sensitive adhesive layer of each of the bra cups 12 on the left and right breasts, and then adjoins the bra cups to each other by engaging the connector 14. The user can create varying degrees of breast cleavage and breast push-up enhancement depending on where the bra cups are positioned on the user's breasts and how much the connector 14 pulls the two bra cups towards each other. Furthermore, the placement of the connector relative to the top and bottom of the bra cups will impact the degree of cleavage and push-up enhancement. Accordingly, the bra 10 enables the user to position the bra cups at a desired position and control the amount of cleavage and push-up enhancement by adjoining the bra cups with the connector. It is also possible, however, for the bra cups to be permanently adjoined together by a fixed connector.

Figure 2:
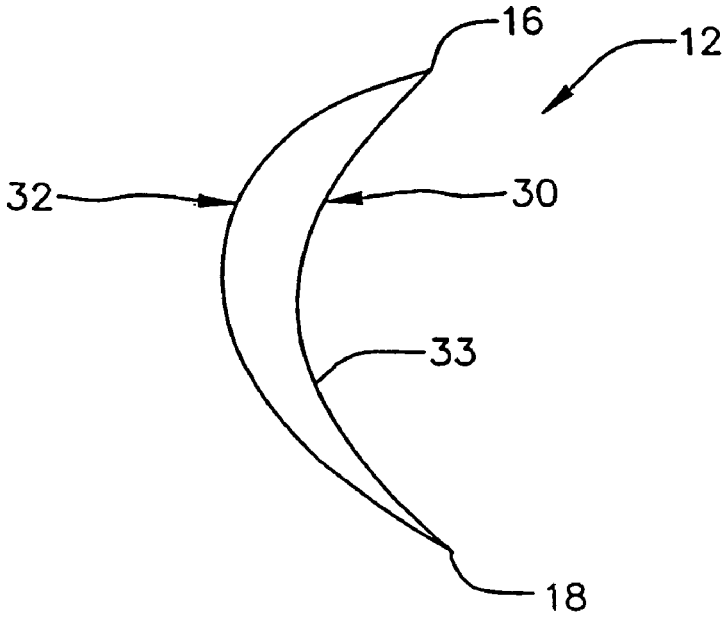
FIG. 2 is a side view of one of the bra cups shown in FIG. 1.
Figure 3:
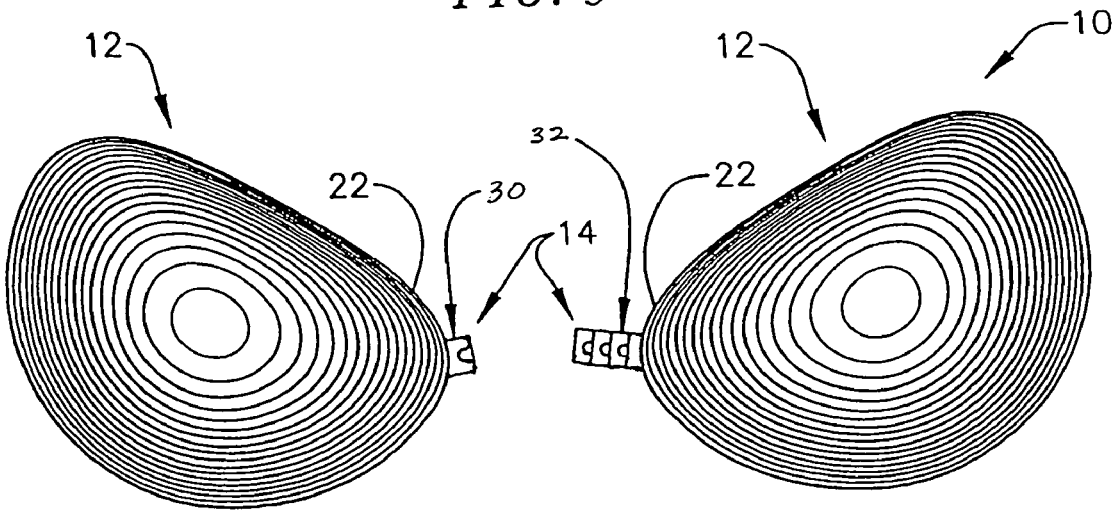
FIG. 3 is a front view of the bra of FIG. 1 showing a connector that has not been engaged to adjoin the bra cups.

A front view of the bra cups 12 is shown in FIG. 1. Each bra cup 12 has a top 16, a bottom 18 opposite the top, an outer side 20, and an inner side 22 opposite the outer side. Each bra cup also defines an inner top 24, an inner middle 26, and an inner bottom 28. Referring to FIG. 2, each bra cup 12 defines two surfaces relative to the user, an interior surface 30 facing towards the user's breasts, and an exterior surface 32 facing opposite the interior surface and away from the user's breasts. At least a portion of the interior surface 30 includes a pressure sensitive adhesive layer 33 that adjoins the bra cups to the user's skin.

The pressure sensitive adhesive (PSA) layer 33 allows the user to place each of the bra cups at a position on the user's breasts that will create a desired support and appearance of the breasts. The amount and type of PSA comprising the pressure sensitive adhesive layer 33 can vary, as can the portions of the interior surface that have the pressure sensitive adhesive layer. Various factors can contribute to the amount, type, and placement of the pressure sensitive adhesive layer such as the size, shape, and weight of the bra cup and the user's breasts, and the type of garment the bra cups are positioned within and the material from which the garment is made. Generally, in exemplary embodiments, approximately 30% to 100% of the interior surface of the bra cups will comprise the pressure sensitive adhesive layer.

The pressure sensitive adhesive layer 33 is preferably a re-usable PSA that is integrally joined with or built-into the interior surface 30 of each bra cup. The pressure sensitive adhesive layer can be applied to the interior surface of the bra cups by various methods such as spray coating, hot melting, extrusion application, die application, or other methods known for applying a PSA to a substrate. One suitable PSA is the silicone gel adhesive disclosed in U.S. Pat. No. 6,200,195 to Furuno et al., wherein the silicone gel adhesive layer is integrally formed with the underlying body. It is also contemplated that other PSA could be used, including double-sided tape. A preferred pressure sensitive adhesive layer 33, such as the PSA disclosed in Furuno et al., will not readily shift once it is positioned on the user and can be re-used without losing its adhesive properties. Such a pressure sensitive adhesive layer 33 has an adhesion force to the bra cups 12 that is greater than an adhesion force to the user's skin, such that when the bra cups are removed from the user's breasts, the adhesive remains on the bra cups and not the user's skin. Such a pressure sensitive adhesive layer is further able to withstand tremendous movement and pressure from the user without slipping and can even be subjected to water or sweat without degeneration of the adhesive properties. In fact, if such a pressure sensitive adhesive layer becomes dirty (i.e. collects unwanted particles such as dust, lint, or debris), it can be cleaned with soap and water to remove the unwanted particles and fully restore the adhesive properties.

The bra cups 12 are each adapted to accommodate the connector 14. The connector 14 can have many different structures, but generally comprises a means for drawing the two bra cups together when positioned on the user's breasts. An exemplary connector comprises two or more separate portions, where a first portion attaches to one bra cup and a second portion attaches to the other bra cup. The first and second portions of the connector are designed to engage each other in order to adjoin the two bra cups. Furthermore, the separate portions of the connector 14 can be either permanently or removably attached to the bra cups. It is also possible for the connector 14 to be a single unit that removably attaches to both bra cups. Moreover, as noted above, connectors can be a part of the garment itself, such as a type of fabric or material positioned between the two bra cups that causes the two bra cups to be drawn together or adjoined.

The bra cups 12 are understood to include a wide variety of structures that are suitable for supporting breasts, such as traditional bras and breast forms, which can be padded, non-padded, and made from any suitable material including one or more types of fabrics, plastics, foams, water, silicones, gels, etc. The materials and sizes of the bra cups can vary depending on the particular style of the garment, the expected use of the garment and bra system, and the preferences of the user.

Exemplary embodiments of suitable bra systems for use with the present garment and bra system are disclosed in U.S. Patent Pub. No. 2004-0023594 A1 entitled "Backless, Strapless Bra" and U.S. Patent Pub. No. 2003-0224700 A1 entitled "Attachable Breast Form Enhancement System," both of which are incorporated herein by reference.

Once the user adjoins the bra cups to their skin and creates the desired look and position, the user can create greater breast cleavage by pulling the bra cups closer. Furthermore, if the user wants to push-up the breasts, the user can position the bra cups at a lower and more outward position on the breasts, so that the bra cups are drawn upward and together by the connector, or the connector can be positioned at a lower region relative to the bra cups. The placement of the connector relative to the top 16 and bottom 18 of the bra cups will vary the amount of push-up enhancement.

The combination of the various above-described types of garments and bra systems can be achieved a number of different ways. One alternative is to add the bra system to the garment without substantially modifying the garment's configuration. In other words, the bra system can be added to a pre-existing garment design by adjoining the bra system to an inside surface the garment. For example, suitable means for adjoining the bra cups to the garment may include sewing, stitching, bonding, heat sealing, using adhesives, using buttons, using snaps, using clasps, and/or using hook and loop fasteners (i.e., VELCRO®). The means for adjoining the bra cups to the garment could be positioned between the exterior surface of the bra cups and the interior surface of the garment. The bra cups could also be adjoined to the garment in ways that involved altering the garment design to at least partially enclose or engage the bra cups.

Figure 4:
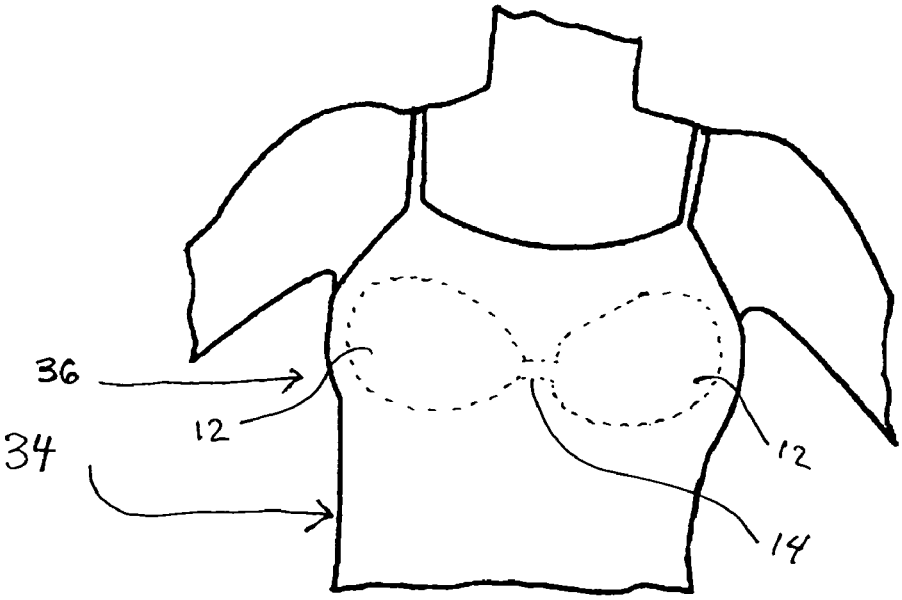
FIG. 4 is an exemplary garment showing the backless, strapless bra of FIG. 1, in phantom, and being worn by a user with the connector engaged.
Figure 5:
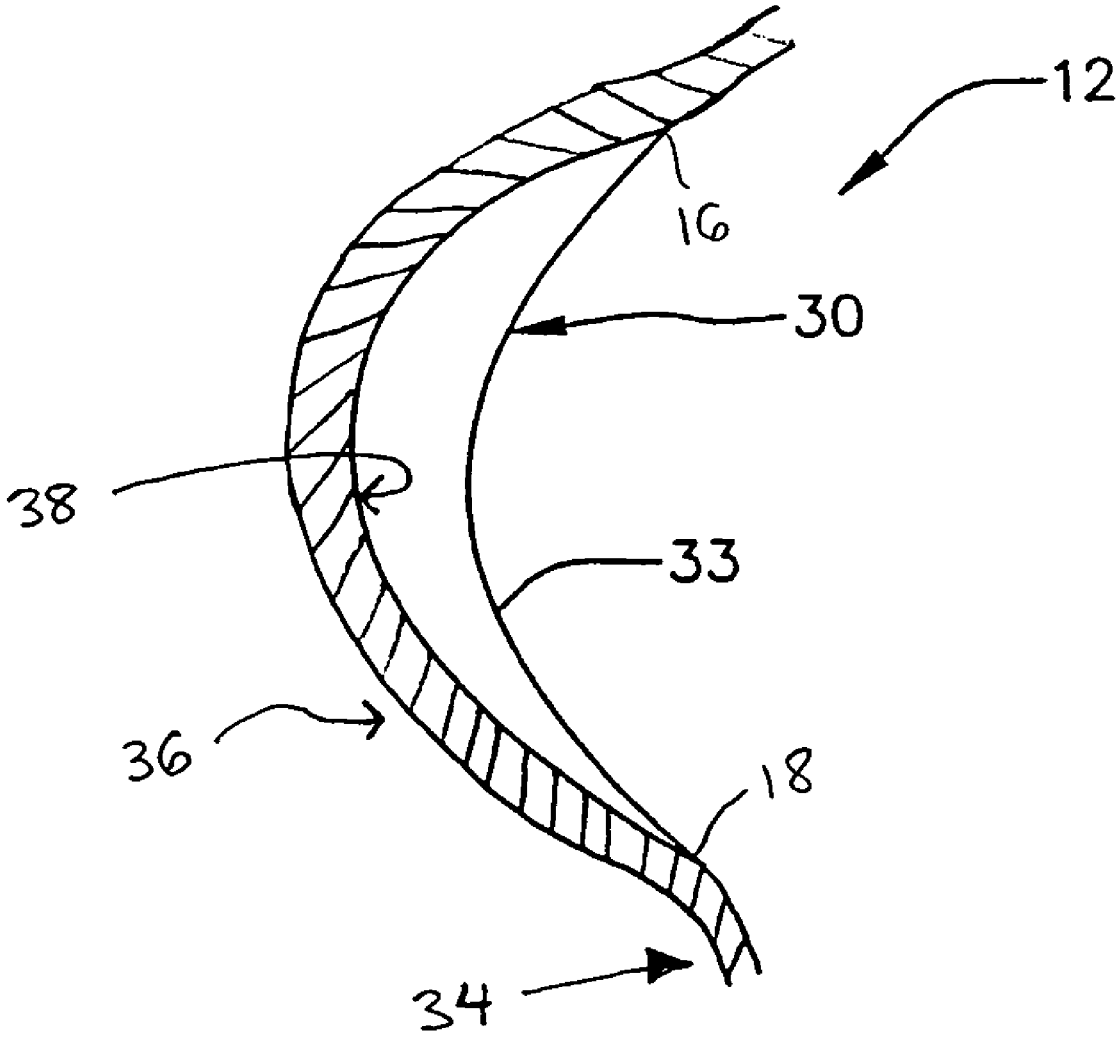
FIG. 5 is a side cross-sectional view of a chest portion of the garment shown in FIG. 4.

An exemplary embodiment of the present garment with integral bra system is shown in FIG. 4 and FIG. 5. The garment 34 is shown as a sleeve-less, tank top type of shirt and is positioned on the user. The garment includes a chest portion 36 that fits over the user's breasts. In FIG. 4, the bra system is depicted in phantom, wherein the bra cups 12 are adjoined to an inside surface 38 (shown in FIG. 5) of the chest portion of the garment, and the bra cups are shown adjoined to the user's breasts and the connector 14 is engaged.

Having a garment with the above-described bra system built-therein allows the garment to replace a traditional bra. Further, the inclusion of a backless, strapless bra in the garment allows the user of the garment to customize the position of the bra cups underneath the garment, such that the user can create a desired degree of breast cleavage and push-up enhancement. The pressure sensitive adhesive layer on the interior surface of the bra cups and the connector between the bra cups makes the garment fully customizable to suit each user's needs and preferences. Furthermore, unlike some known bra cups that are not built-into the garment, the present bra cups will not fall-out or pop-out of the garment even if the adhesive layer became detached from the user's skin.

The present garment with integral bra system gives rise to an improved method of using a garment to replace a traditional bra and allow for adjustable breast cleavage and push-up enhancement. The user can wear the garment (i.e., a shirt, swimsuit, etc.) for its intended purpose, yet have the ability to individually position each of the bra cups in a desired position on the user's breasts and then draw the bra cups together with the connector in order to create the desired shape and appearance of their breasts. An exemplary method of using the garment comprises positioning the garment on the user's body such that the bra cups adjoined to the inside surface of the garment are oriented towards the user's breasts; independently positioning the bra cups over each of the user's breasts, wherein the interior surface of the bra cups are adapted for placement over the user's breasts; adjoining the pressure sensitive adhesive layer disposed along the interior surface of each of the bra cups to a desired position on the user's breasts, wherein the pressure sensitive adhesive layer of each bra cup is sufficiently readily removed from the user's breast independently of the other bra cup to be repositionable relative to the user's breast and to the adjacent bra cup; adjoining the bra cups together by engaging the connector positioned between inner sides of each of the bra cups, wherein the first portion and second portion of the connector are adapted to cooperatively engage, whereby engaging the first portion and the second portion moves the bra cups and the user's breasts together and creates an amount of breast cleavage; adjusting the amount of breast cleavage by removing at least one of the bra cups from the user's breasts and repositioning the bra cups at a different position on the user's breasts, such that the distance between the inner sides of the bra cups before they are adjoined together affects the amount of breast cleavage created when the bra cups are adjoined together.

In addition to the specific features and embodiments described above, it is understood that the present invention includes all equivalents to the structures and features described herein, and is not to be limited to the disclosed embodiments. For example, the size and shape of the bra cups can be varied to any configuration desired by a user of a bra, including various types of partial cup constructions that cover different portions of the user's breasts. The same flexibility for practicing the invention is true with respect to the particular garment that is selected for combination with the bra system. Additionally, individuals skilled in the art to which the present garment with integral bra system pertains will understand that variations and modifications to the embodiments described can be used beneficially without departing from the scope of the invention.

What is claimed is:

1. A method of using a garment having an integral adjustable backless, strapless bra comprising:

positioning the garment on the user's body such that a pair of bra cups adjoined to an inside surface of the garment is oriented towards a user's breasts;

independently positioning the bra cups over each of the user's breasts, wherein the bra cups have an interior surface adapted for placement over the user's breasts;

adjoining a pressure sensitive adhesive layer disposed along the interior surface of each of the bra cups to a desired position on the user's breasts, wherein the pressure sensitive adhesive layer of each bra cup is sufficiently readily removed from the user's breast independently of the other bra cup to be repositionable relative to the user's breast and to the adjacent bra cup; and drawing the bra cups together with a connector positioned between the bra cups.

2. The method of claim 1 wherein the connector comprises a first portion attached to an inner side of one of the bra cups and a second portion attached to an inner side of the other bra cup, wherein the first portion and the second portion are adapted to cooperatively engage.

3. The method of claim 1 wherein the connector is integral with the inside surface of the garment.

4. The method of claim 1 wherein each bra cup comprises an outer side facing opposite the inner side and towards the user's armpit, and the bra cup is secured to the user's breast by the pressure sensitive adhesive layer.

5. A method of using a garment having a backless, strapless bra built-into the garment to adjust breast cleavage comprising:

positioning the garment on the user's body such that a pair of bra cups adjoined to an inside surface of the garment is oriented towards a user's breasts;

independently positioning the bra cups over each of the user's breasts, wherein the bra cups have an interior surface adapted for placement over the user's breasts;

adjoining a pressure sensitive adhesive layer disposed along the interior surface of each of the bra cups to a desired position on the user's breasts, wherein the pressure sensitive adhesive layer of each bra cup is sufficiently readily removed from the user's breast independently of the other bra cup to be repositionable relative to the user's breast and to the adjacent bra cup;

drawing the bra cups together by a connector positioned between the bra cups, wherein an amount of breast cleavage is created; and adjusting the amount of breast cleavage by removing at least one of the bra cups from the user's breasts and repositioning the bra cups at a different position on the user's breasts, such that a distance between inner sides of the bra cups before they are drawn together affects the amount of breast cleavage created when the bra cups are drawn together.

6. The method of claim 5 wherein the connector comprises a first portion attached to the inner side of one of the bra cups and a second portion attached to the inner side of the other bra cup, wherein the first portion and the second portion are adapted to cooperatively engage, whereby engaging the first portion and the second portion moves the bra cups and user's breasts together.

7. The method of claim 5 wherein the connector is integral with the inside surface of the garment.

8. The method of claim 5 also comprising increasing the distance between the inner sides of the bra cups before they are drawn together to increase the amount of breast cleavage created when the bra cups are adjoined together.

9. The method of claim 5 also comprising decreasing the distance between the inner sides of the bra cups before they are drawn together to decrease the amount of breast cleavage created when the bra cups are drawn together.

10. The method of claim 5 wherein each bra cup comprises an outer side facing opposite the inner side and towards the user's armpit, and the bra cup is secured to the user's breast by the pressure sensitive adhesive layer.

11. A garment having an integral backless, strapless bra comprising:

a chest portion facing towards a user's breasts;

a pair of bra cups adjoined to an inside surface of the chest portion, wherein each bra cup comprises:

an interior surface facing towards a user's breast and an exterior surface facing opposite the interior surface, wherein the interior surface comprises a pressure sensitive adhesive layer for adjoining the bra cups to the user's breast; and a connector adapted to draw the bra cups together.

12. The garment of claim 11 wherein the connector comprises a first portion attached to an inner side of one of the bra cups and a second portion attached to an inner side of the other bra cup, wherein the first portion and the second portion are adapted to cooperatively engage.

13. The garment of claim 11 wherein the connector is integral with the inside surface of the garment.

14. The garment of claim 11 wherein the bra cups are permanently adjoined to the inside surface of the chest portion.

15. The garment of claim 11 wherein at least thirty percent of the interior surface of the bra cups comprises the pressure sensitive adhesive layer.

16. The garment of claim 11 wherein the garment is either a shirt, a dress, or a swimsuit.

17. The garment of claim 16 wherein the garment comprises a material that is at least two-way stretchable in a lateral direction across the user's chest.

* * * * *